United States Patent [19]

Hamada

[11] Patent Number: 4,596,079

[45] Date of Patent: Jun. 24, 1986

[54] HEATING AND DRYING APPARATUS FOR POWDERY OR GRANULAR MATERIALS

[75] Inventor: Yoshiyuki Hamada, Tokyo, Japan

[73] Assignee: Kabushiki Kaisha Masuno Seisakusho, Tokyo, Japan

[21] Appl. No.: 586,758

[22] Filed: Mar. 6, 1984

[30] Foreign Application Priority Data

Feb. 1, 1983 [JP] Japan ..... 58-13718

[51] Int. Cl.[4] ..... F26B 17/14

[52] U.S. Cl. ..... 34/171; 34/168; 34/170

[58] Field of Search ..... 34/170, 171, 57 R, 57 A, 34/168

[56] References Cited

U.S. PATENT DOCUMENTS

| | | | |
|---|---|---|---|
| 504,320 | 9/1893 | Borgarelli | 34/170 |
| 620,458 | 2/1899 | Kennedy | 34/170 |
| 1,265,298 | 5/1918 | Bowman | 34/170 |
| 1,737,061 | 11/1929 | Ryder | 34/170 |

FOREIGN PATENT DOCUMENTS

| | | | |
|---|---|---|---|
| 764697 | 5/1934 | France | 34/170 |
| 2066178 | 7/1971 | France . | |

*Primary Examiner*—Larry I. Schwartz

*Attorney, Agent, or Firm*—Wenderoth, Lind & Ponack

[57] ABSTRACT

A heating and drying apparatus for powdery or granular materials, including a hollow column consisting of an upper disaggregation heat-exchange chamber having a plurality of baffle plates disposed therein arrayed in multiple stages with gap spaced retained between the adjacent baffle plates in the vertical and horizontal directions and a lower fluidized state heat-exchange chamber connected in series wth the upper chamber, a feeder of a material to be treated and an exhaust gas outlet port, both provided at the top portion of the upper chamber, and a heating gas inlet port and a treated material discharge device, both provided at the bottom portion of the lower chamber.

3 Claims, 5 Drawing Figures

HEATING AND DRYING APPARATUS FOR POWDERY OR GRANULAR MATERIALS

BACKGROUND OF THE INVENTION

The present invention relates to a heating and drying apparatus for powdery or granular materials.

Heretofore, for heating and drying powdery or granular materials, because of its extremely high thermal efficiency and simplicity, a fluidized state heat-exchanger in which the powdery or granular material flows in one direction take continuously heated and dried by a counterflow of a hot gas, has been widely employed.

However, in the case of treating powdery or granular materials which are wet and aggregated due to moisture, there was a problem that if such material was thrown into the fluidized state heat-exchanger, formation of a fluidized flow of the material became difficult due to aggregation of the material, and so, the fluidized state heat-exchanger could not be fully utilized.

OBJECT AND SUMMARY OF THE INVENTION

It is therefore one object of the present invention to provide a novel heating and drying apparatus for powdery or granular materials, in which even if the material to be treated is wet and aggregated, it can be disaggregated and can form a fluidized flow, and thereby highly efficient heat-exchange in a fluidized state with a counterflow of a hot gas can be achieved.

According to one feature of the present invention, there is provided a heating and drying apparatus for powdery or granular materials comprising a hollow column consisting of an upper disaggregation heat-exchange chamber having a plurality of baffle plates disposed therein arrayed in multiple stages with gap spaces retained between the adjacent baffle plates in the vertical and horizontal directions and a lower fluidized state heat-exchange chamber connected in series with the upper chamber, a feeder of a material to be treated and an exhaust gas outlet port, both provided at the top portion of the upper chamber, and a heating gas inlet port and a treated material discharge device both provided at the bottom portion of the lower chamber.

In the heating and drying apparatus for powdery or granular materials according to the present invention, since the disaggregation heat-exchange chamber occupying the upper portion of the hollow column and connected in series with the lower fluidized state heat-exchange chamber has a plurality of baffle plates disposed therein arrayed in multiple stages with gap spaces retained between the adjacent baffle plates in the vertical and horizontal directions, when a material to be treated is thrown into the upper disaggregation heat-exchange chamber through the feeder provided at the top portion of the upper chamber and a heating gas is supplied through the heating gas inlet port provided at the bottom portion of the lower chamber, the material thrown into the upper chamber from its top portion would collide with the baffle plates resulting in slowdown of the falling speed of the material, at the same time the baffle plates serve as impacting plates for the material blown up from below as carried by the heating gas, hence the material to be treated would fall gradually while moving up and down between upper and lower opposed baffle plates, and thus drying of the material is effected while the material is kept in efficient contact with the heating gas rising from the lower fluidized state heat-exchange chamber over a long period of time as maintained in a floating state. Therefore, in the upper disaggregation heat-exchange chamber, binding forces in the aggregated blocks of the material to be treated are gradually weakened, hence the aggregated blocks are disaggregated by the repeated collisions between the material and the baffle plates as well as mutual collisions between the falling aggregated blocks per se of the material, and thereby the material to be treated can be fed to the lower fluidized state heat-exchange chamber in a preheated and fluidized state.

Accordingly, even a wet and aggregated material which could be hardly treated by the heretofore known fluidized state heat-exchanger, can be easily brought into a fluidized state suitable for such heat-exchangers, and thus the aforementioned object of the present invention can be achieved.

Moreover, even in the case of a material not containing aggregated blocks, since the sensible heat possessed by the heating gas supplied from the lower fluidized state heat-exchange chamber is utilized for heating and drying of the material to be treated in the upper disaggregation heat-exchange chamber, the thermal efficiency of the fluidized state heat-exchange chamber can be remarkably enhanced as compared to the fluidized state heat-exchangers in the prior art. In addition, since the material to be treated is fed to the lower fluidized state heat-exchange chamber in a state presenting an improved fluidity, a high heat-exchange efficiency which could not be realized in such heat-exchangers in the prior art can be attained.

Still further, although a fluidized state heat-exchanger is generally associated with a very large pressure loss, according to the present invention the overall pressure loss in the heating and drying apparatus is very small because the fluidized state heat-exchange is effected only in the final stage of the process, that is, only in the lower fluidized heat-exchange chamber and in the upper disaggregation heat-exchange chamber the material to be treated is subjected to heat-exchange with the heating gas blown up at appropriate speed while the material is falling from the top portion of the hollow column. Therefore, as a whole the apparatus according to the present invention necessitates less mechanical power as compared to the case where the same material is treated by means of only a fluidized state heat-exchanger. In addition, the apparatus according to the present invention is not only available for drying of a material to be treated, but also it can be reasonably utilized as a preheating apparatus.

BRIEF DESCRIPTIONS OF THE DRAWINGS

The above-mentioned and other objects, features and advantages of the invention will become more apparent by reference to the following description of preferred embodiments of the invention taken in conjunction with the accompanying drawings, wherein:

FIG. 1 is a schematic longitudinal cross sectional view showing one preferred embodiment of the heating and drying apparatus for powdery or granular materials according to the present invention, FIG. 2 is an enlarged longitudinal cross sectional view of an upper disaggregation heat-exchange chamber in the heating and drying apparatus shown in FIG. 1, and FIGS. 3(*a*), 3(*b*) and 3(*c*) shows various possible internal structures of a lower fluidized state heat-exchange chamber in the heating and drying apparatus shown in FIG. 1.

DETAILED DESCRIPTION OF THE PREFERRED EMBODIMENTS

Figure 1:
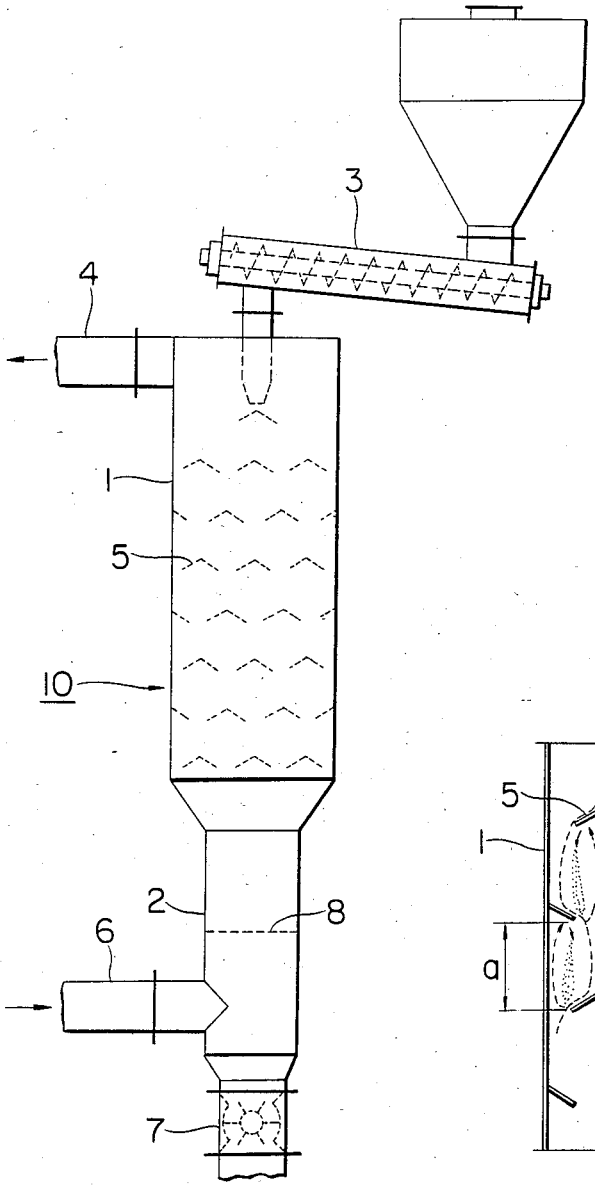

Now the present invention will be described in greater detail with reference to FIGS. 1 to 3 of the drawings.

A hollow column (10) forming a principal part of the heating and drying apparatus consists of a disaggregation heat-exchange chamber (1) occupying the upper portion of the hollow column (10) and a fluidized state heat-exchange chamber (2) having a somewhat smaller diameter than the upper chamber (1) and connected to the bottom of the upper chamber (1), and at the top portion of the disaggregation heat-exchange chamber (1) are provided a feeder (3) of a material to be treated and an exhaust gas outlet port (4).

Figure 2:
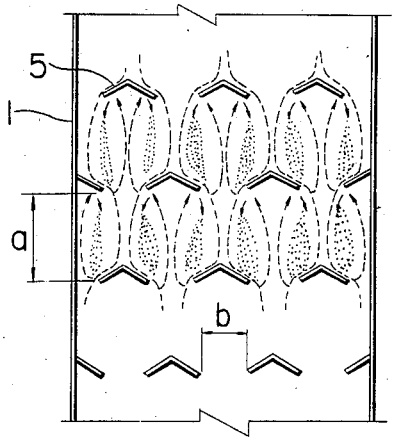
Figure 3:
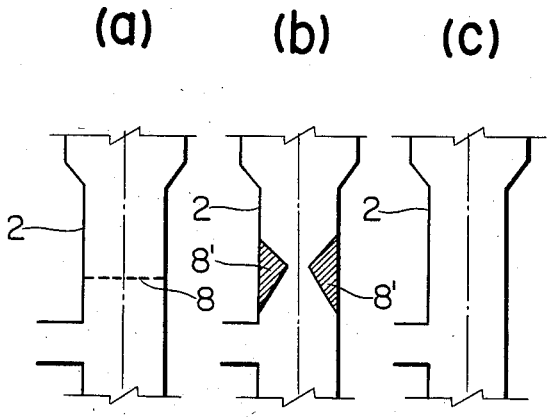

Within the disaggregation heat-exchange chamber (1) are disposed a plurality of baffle plates (5) having an angle-shaped or any other arbitrary cross-section arrayed in multiple stages, and as best seen in FIG. 2, appropriate gap distances (a) and (b) are retained between the adjacent baffle plates (5) in the respective vertical and horizontal directions. In the illustrated embodiment, the baffle plates (5) are made of bars having angle-shaped cross sections and extending horizontally in parallel to each other with the apexes of the angle directed upwardly. The adjacent stages of the baffle plates (5) are disposed in a staggered relationshp to each other so that an apex line of one baffle plate (5) in one stage may lie under the centerline of the gap space between two adjacent baffle plates (5) in the next upper stage. The horizontal gap distances (b) no greater than the widths of the baffle plate 5. Also, at the bottom portion of the fluidized state heat-exchange chamber (2) are provided a heating gas inlet port (6) and a treated material discharge device (7).

Since the illustrated apparatus is constructed in the above-described manner, when a material to be treated containing wet aggregated blocks is thrown into the disaggregation heat-exchange chamber (1) through the feeder (3) and a heating gas at an elevated temperature is supplied through the heating gas inlet port (6), the thrown material would collide with the baffle plates (5), resulting in slowdown of the falling speed of the material, at the same time the same material to be treated which is blown up from the below as carried by the heating gas supplied from the fluidized state heat-exchange chamber (2) would collide with the lower surfaces of the baffle plates (5), and thus the material falls gradually while moving up and down between upper and lower opposed baffle plates (5) in a swirling motion in oval paths as illustrated in FIG. 2. Therefore, the heat-exchange time between the material to be treated and the heating gas is prolonged, and also good contact is made between the material and the heating gas, so that the thermal efficiency of the heating and drying apparatus can be enhanced.

As described above, the collisions between the material to be treated and the baffle plates (5) are repeated, and during the falling of the material, the particles or blocks of the material in themselves would collide with each other. Hence, in view of the fact that the heat-exchange between the falling material and the heating gas flowing upwardly is fully achieved, the aggregated blocks, if any exist, of the material to be treated can be disaggregated in the disaggregation heat-exchange chamber (1), and so, the material to be treated is fed to the fluidized state heat-exchange chamber (2) in a fully fluidized state. Therefore, the heat-exchange in the fluidized state heat-exchange chamber (2) can be achieved efficiently, and the well heated and dried material can be discharged through the treated material discharge device (7).

Since the material to be treated is subjected to heat-exchange with the heating gas flow having an appropriate rising speed while the material is falling through the disaggregation heat exchange chamber (1) as described above, a pressure loss in the heating and drying apparatus is not so large, and as a mechanical power necessitated for moving the material, only the mechanical power for conveying the material up to the top portion of the upper disaggregation heat-exchange chamber (1) and the mechanical power of the feeder (3) and a blower connected to the heating gas inlet port (6) are necessary. Besides, the necessary mechanical power is very small because the material to be treated would fall naturally under the gravity through the upper chamber (1) and the lower chamber (2).

It is to be noted that while heating gas which has finished the heat-exchange is exhausted through the exhaust gas outlet port (4) provided at the top portion of the disaggregation heat-exchange chamber (1), the amount of the material to be treated which is discharged to the outside of the upper chamber (1) jointly with the exhaust gas is very small because the heating gas flow is reduced in speed when it passes through the gap spaces between the baffle plates (5) and the baffle plates (5) also serve as impacting plates which achieve a dust collecting effect.

It is also to be noted that the exhaust gas at an elevated temperature discharged through the exhaust gas outlet port (4) could be re-used by leading the exhaust gas to an exhaust gas reutilization device (not shown) connected between the exhaust gas outlet port (4) and the heating gas inlet port (6).

With reference to FIG. 1, in the illustrated embodiment, the fluidized state heat-exchange chamber (2) is provided with a perforated plate (8) disposed horizontally in the middle portion of the chamber (2), and this perforated plate (8) is useful for realizing uniform mixing between the falling fluidized material and the upwardly blown heating gas. However, it is to be noted that the number and size of the perforations in the perforated plate (8) could be appropriately selected depending upon the properties of the material introduced into the fluidized state heat-exchange chamber (2). Also depending upon the properties, sometimes the perforated plate (8) could be omitted as shown in FIG. 3(*c*). Furthermore, in some cases, as shown in FIG. 3(*b*), in place of the perforated plate (8) an annular protrusion (8') is provided on the inner peripheral surface of the fluidized state heat-exchange chamber (2) in its middle portion to form a choke where a jet flow of the heating gas is produced. FIG. 3(*a*) shows the same perforated plate (8) as that shown in FIG. 1. In any event, the internal structures of the fluidized state heat-exchange chamber (2) as shown in FIGS. 3(*a*)–3(*c*) are selected depending upon the properties of the material introduced into the chamber (2) as well as the conditions of the heating gas flow.

While the present invention has been described above in connection with preferred embodiments thereof, as a matter of course, the invention should not be limited to the illustrated embodiments but various changes in design could be made without departing from the spirit of the present invention.

What is claimed is:

1. An apparatus for heating and drying powdery or granular materials, comprising:

a hollow vertical column defining an upper disaggrevation heat-exchange chamber and a lower fluidized state heat-exchange chamber below, series connected to, and in communication with said upper chamber;

a feeder of material to be heat treated and an exhaust gas outlet port, located at the top of said upper chamber in communication therewith;

a heating gas inlet port and treated material discharge device, located at the bottom of said lower chamber; and means, responsive to heating gas flowing upward through said lower chamber from said inlet port, for swirling the materials flowing down through said lower chamber;

said swirling means including a plurality of vertically spaced, horizontally planar arrays of baffle plates having angle-shaped cross sections and extending horizontally in parallel to each other, each of said arrays including a respective plurality of said baffle plates, said baffle plates having respective side portions which intersect at angles with apexes directed upward, the baffle plates in each array being serially spaced by respective horizontal empty gaps, each adjacent pair of said arrays having a respective empty space therebetween over substantially the entire horizontal extent thereof; the baffle plates in adjacent pairs of said arrays extending parallelly and being staggered horizontally so that in each said adjacent pair, each of said baffle plates of each array is vertically aligned with, and has a width at least as great as the width of the one of said horizontal empty gaps of the other array directly thereabove;

the empty spaces and the empty gaps having such dimensions in relation to said baffle plates that said swirling is produced on the materials flowing down through each of said empty gaps in oval paths between the upper surfaces of the side portions of the baffle plate on opposite sides of the apex thereof, directly below said each of said empty gaps and the lower surfaces of the respective side portions of the baffle plates thereabove, closest to said respective upper surfaces.

2. A heating and drying apparatus for powdery or granular materials as claimed in claim 1, further comprising a perforated plate disposed horizontally in a middle portion of said lower fluidized heat-exchange chamber.

3. A heating and drying apparatus for powdery or granular materials as claimed in claim 1, further comprising an annular protrusion on an inner peripheral surface of said lower fluidized state heat-exchange chamber in a middle portion thereof to form a choke where a jet flow of the heating gas is produced.

* * * * *